United States Patent [19]

Okamoto et al.

[11] 4,120,722

[45] Oct. 17, 1978

[54] THERMAL DEVELOPMENT OF IMAGED LIGHT-SENSITIVE RECORDING MATERIAL USING MICROWAVES

[75] Inventors: Yoshihiko Okamoto; Takahiro Ohta, both of Asaka, Japan

[73] Assignee: Fuji Photo Film Co., Ltd., Minami-ashigara, Japan

[21] Appl. No.: 788,385

[22] Filed: Apr. 18, 1977

Related U.S. Application Data

[63] Continuation of Ser. No. 596,124, Jul. 15, 1975, abandoned.

[30] Foreign Application Priority Data

Jul. 15, 1974 [JP] Japan ..... 49-81361

[51] Int. Cl.[2] ..... G03C 5/34; G03C 5/24

[52] U.S. Cl. ..... 96/49; 96/48 HD; 96/50 R; 96/63; 96/66 R; 96/66 T; 96/114.1; 96/75; 96/67; 96/86 R; 96/87 R

[58] Field of Search ..... 96/49, 75, 114.1, 48 HD, 96/50 R, 66 R, 66 T, 63

[56] References Cited

U.S. PATENT DOCUMENTS

| | | | |
|---|---|---|---|
| 2,699,392 | 1/1955 | Herrick | 96/49 |
| 3,032,414 | 5/1962 | James et al. | 96/49 |
| 3,408,192 | 10/1968 | Aebi | 96/49 |
| 3,607,273 | 9/1971 | Kinney | 96/75 |
| 3,748,137 | 7/1973 | Worth et al. | 96/49 |
| 3,759,711 | 9/1973 | Rauneu et al. | 96/75 |
| 3,785,821 | 1/1974 | Notley | 96/49 |

FOREIGN PATENT DOCUMENTS

| | | | |
|---|---|---|---|
| 645,825 | 11/1950 | United Kingdom | 96/49 |

OTHER PUBLICATIONS

"Chemical Abstracts", vol. 70, 1969, Abstract #15991t.

Curtis, F. W., "High-Frequency Induction Heating", McGraw-Hill Book Co., 2nd Ed., 1950, pp. 1-20.

*Primary Examiner*—Charles L. Bowers, Jr.

*Attorney, Agent, or Firm*—Sughrue, Rothwell, Mion, Zinn and Macpeak

[57] ABSTRACT

A process for thermal development, which comprises irradiating with microwaves an imagewise exposed thermally developable recording material in thermal contact with a conductive layer or material having a surface electric resistance ranging from about 1 ohm/□ to about $10^5$ ohm/□, whereby the heat generated in the conductive layer or material develops the thermally developable recording material.

5 Claims, 3 Drawing Figures

THERMAL DEVELOPMENT OF IMAGED LIGHT-SENSITIVE RECORDING MATERIAL USING MICROWAVES

This is a continuation of application Ser. No. 596,124 filed on July 15, 1975, now abandoned.

BACKGROUND OF THE INVENTION

1. Field of the Invention

This invention relates to a method of thermal development, and more particularly relates to a method of thermal development of a thermally developable light-sensitive recording material using microwaves.

2. Description of the Prior Art

As compared with the conventional process of heating a light-sensitive layer through heat conduction or the like using a heater, the process of thermal development using microwaves has the advantage that the time elapsed from the application of an electric potential to an apparatus to reach a thermally developable temperature, i.e., the warming-up time of the apparatus, is extremely short. Therefore, the apparatus need not be left turned on resulting in a saving of electric power. Further, heating with microwaves eliminates the possibility of damage of a light-sensitive layer since heating without contact is possible.

A thermally developable recording material as described above usually has a structure in which a thermally developable light-sensitive layer is formed on a support, such as paper, a synthetic resin sheet, glass, etc., either directly on the support or on a subbing layer on the support. However, this recording material has the defect that, upon thermal development of a recording material with this structure by placing the recording material in a microwave field, as long as 4 to 5 minutes is required for enough heat to be generated to thermally develop the recording material since the microwave energy is scarcely absorbed by the recording material.

As one means to overcome this defect, a suggestion has been to provide a dielectric substance having a high dielectric constant and a high dielectric loss tangent in or on a support of a recording material or in a light-sensitive layer to thereby accelerate heating, as described in, e.g., Japanese patent publication No. 18,039/72. However, recent experiments which have now been conducted have shown that, even when a recording material containing such a dielectric substance is heated using microwaves, almost no effects were obtained.

That is, the penetration depth of the microwaves absorbed by a dielectric substance is generally high, and a support such as a paper, a polyethylene terephthalate sheet, soda glass or the like shows a penetration depth as high as 10 to 100 cm for microwaves of a frequency of 2450 MHz. While extremely effective heating is attained in heating a material having such a thickness, in heating a thin material (e.g., a thickness of about 100 $\mu$) such as a light-sensitive material, microwaves are scarcely absorbed by a light-sensitive layer even when a substance having a high dielectric constant and a high dielectric loss tangent are used or added, thus failing to greatly increase the heating efficiency. The reason for this is that the heating efficiency of a dielectric substance in absorbing the energy of the microwaves increases as the dielectric constant and the dielectric loss tangent of the substance increases. A dielectric substance such as a paper, a polyethylene terephthalate sheet, soda glass or the like, however, generally has a low absorbing efficiency, and the depth (penetration depth) required to absorb one half of the energy of the microwaves by the dielectric substance is about 10 to 100 cm. Here, the absorbing efficiency for the microwaves per unit of depth is high with a shallow penetration depth of the microwaves. In a thin dielectric substance (e.g., a thickness of about 100 $\mu$), the heating efficiency can be increased in any manner in which the dielectric constant and the dielectric loss tangent thereof can be increased such as using or adding a substance having a high dielectric constant and a high dielectric loss tangent. However, even this fails to greatly increase the heat efficiency because of low absorbing efficiency of the substance for the microwaves themselves.

SUMMARY OF THE INVENTION

As a result of various investigations, a process absolutely different from the above-described process has now been found, i.e., that thermal development can be effected in an extremely short time with efficiency by irradiating a thermally developable light-sensitive layer in thermal contact with a conductive layer or material having a surface electric resistance of about 1 to $10^5$ ohm/□ with microwaves.

DETAILED DESCRIPTION OF THE INVENTION

Figure 1:
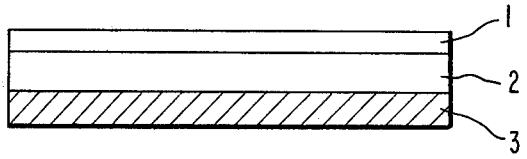
FIGS. 1 to 3 are cross sectional views showing the structures of embodiments of thermally developable recording materials which can be used in the present invention, wherein numeral 1 designates a light-sensitive layer, 2 a support, *2a* a binder, *2b* a conductive powder, 3 a conductive layer and 3' a conductive sheet.

The process of this invention can possibly be explained by the following. A surface electric current action specific to conductive materials is produced in the conductive layer or material having a surface electric resistance of about 1 to $10^5$ ohm/□ and, when a conductive layer or material having such a surface resistance is irradiated with microwaves, the penetration depth of the surface electric current can be adjusted to about 1 to 10 $\mu$, which enables the effective heating of a thin material such as a light-sensitive material.

The term "thermally developable recording material", as used herein is used to describe, for example, the following types of materials:

(1) A thermally developable light-sensitive recording material, which is prepared by adding a developing agent and a material which releases an alkali upon heating, and which is to be heated after exposure for development (e.g., as disclosed in U.S. Pat. No. 3,523,795).

(2) A thermally developable diazo recording material utilizing the photolysis of a diazonium salt, which provides dye images by reaction of the remaining diazonium salt with a coupler (e.g., as disclosed in U.S. Pat. Nos. 2,732,299 and 3,076,707).

(3) A vesicular recording material, wherein nitrogen gas is produced by the photolysis of a diazonium salt in a synthetic resin, and the thus-produced gas is expanded by heating to form fine cells in the synthetic resin, these image-wise distributed cells forming a negative or positive image through scattering or reflection of light (e.g., as disclosed in U.S. Pat. No. 3,143,418).

(4) A thermally developable light-sensitive (dry-silver) recording material comprising a substantially light-insensitive organic silver salt, a light-sensitive silver halide, and a reducing agent and optionally a sensitizing dye as main components, where the Ag of the silver halide forms a latent image upon exposure, and in heating the thus-exposed material, the exposed silver halide accelerates the development and the organic silver salt is reduced by the reducing agent to form an image (e.g., as disclosed in U.S. Pat. Nos. 3,152,904 and 3,457,075 and in J. Kosar, *Light Sensitive Systems).*

The thermal contact of a light-sensitive layer with a conductive layer or material not only includes the intimate contacting of a light-sensitive layer physically with the conductive layer, but includes any embodiment in which heat generated in the conductive layer can be conducted to the light-sensitive layer. For example, the following embodiments are included.

(1) The support itself of the recording material becomes the conductive layer by using a conductive substance as the support, or by incorporating a conductive substance in a suitable binder and using such as a support.

(2) A conductive substance is formed on a support, e.g., by vacuum evaporation, or is formed on a support, e.g., by coating a conductive substance alone or in combination with a suitable binder.

(3) The light-sensitive layer itself becomes the conductive layer by incorporating a conductive substance in the light-sensitive layer.

(4) Another sheet which is conductive is superposed on the recording material and such is used as a conductive layer.

In embodiments (1), (2) and (4) described above, one or more heat-conductive layers can be interposed between the light-sensitive layer and the conductive layer.

When a recording material containing a conductive layer as described above is placed in a microwave field, heat is generated in the conductive layer in an extremely short time, and the light-sensitive layer is heated and thermal development occurs.

Suitable conductive layers which can be used in the present invention include those which have a surface resistance value of about 1 ohm/□ to about $10^5$ ohm/□. In particular, for microwaves of a frequency of 915 MHz and 2450 MHz which are allocated for commercial use and are ordinarily used for heating, the conductive layer preferably has a surface resistance of $10^2$ ohm/□ to $10^3$ ohm/□. Examples of such layers are those which are prepared by vacuum-evaporating various metals including copper, nickel, chromium, zinc, aluminum, etc., and metal oxides such as tin oxide, indium oxide, etc., onto a support. Also, suitable layers can be obtained by mixing graphite, carbon black or a like conductive powder in a binder which is heat-resistant at the development temperature, e.g., a polyester, to be employed and coating this composition on a support. The same effects can be obtained by conducting development by superposing a conductive sheet such as a conductive layer on a non-conductive recording material. Typical frequencies for the microwaves which can be used in this invention can range from about 300 to 3,000 MHz.

In forming a conductive layer by incorporating a conductive substance in a binder, various surface resistances can be easily prepared by increasing or decreasing the amount of the conductive substance added to the binder.

The recording material and the process of the thermal development of the present invention using the above-described conductive substance will now be illustrated below by reference to the accompanying drawings.

In FIG. 1, numeral 1 designates a thermally developable light-sensitive layer, 2 a support, and 3 a conductive layer. Conductive layer 3 can, of course, be interposed between light-sensitive layer 1 and support 2. This recording material shown in FIG. 1 is formed by, e.g., providing the above conductive substance on an ordinary support 2 made of paper, a synthetic resin sheet, glass or the like through vacuum-evaporation, coating, etc., and then forming thereon the thermally developable light-sensitive layer 1.

Figure 2:
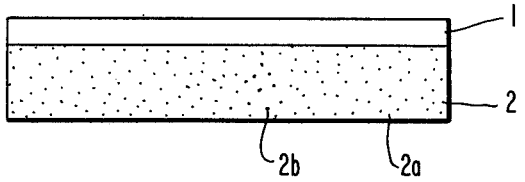

In FIG. 2, numeral 1 designates a light-sensitive layer, and 2 a support. Support 2 is formed by incorporating a powder of the above-described conductive substance **2*b* in a binder 2*a*. That is, when support 2** is paper, the above conductive substance can be incorporated therein together with the pulp and other materials during the production of the paper. Also, when the support is a synthetic resin sheet, the above conductive substance can be added to and mixed with the molten synthetic resin under heating or using a solvent prior to forming the synthetic resin into a sheet, and then forming the synthetic resin into a sheet appropriately using conventional techniques such as a casting process, an extrusion process, etc.

Figure 3:
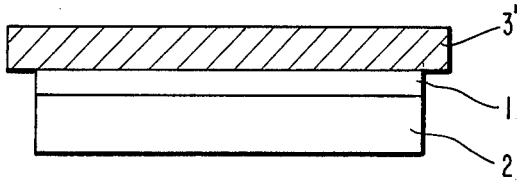

In FIG. 3, numeral 1 designates a light-sensitive layer, 2 a support, and 3' a conductive sheet, which conductive sheet 3' is superposed on the light-sensitive layer 1 during irradiation with microwaves for thermal development.

The following examples are given to illustrate the present invention in greater detail. Unless otherwise indicated herein, all parts, percents, ratios and the like are by weight.

EXAMPLE 1

On a transparent bi-axially stretched polyethylene terephthalate film having vacuum-evaporated thereon a metal (transparent conductive Lumirror, made by Toray Industries, Inc.) was coated a thermally developable light-sensitive emulsion to obtain a recording material. The surface resistance of the conductive layer was $10^3$ ohm/□. The light-sensitive layer contained silver bromide as a light-sensitive silver halide and silver behenate as a substantially light-insensitive long-chain fatty acid silver salt, 1,1-bis(2-hydroxy-3,5-dimethylphenyl)-3,5,5-trimethylhexane as a reducing agent and 3-p-carboxyphenyl-5-[β-ethyl-2-(3-benzoxazolylidenyl-)ethylidenyl]rhodanine as a sensitizing dye as main components, and was adhered to the film support using polyvinyl butyral as a binder. When the light-sensitive layer is irradiated with light, the Ag of silver halide which is exposed forms latent image nuclei. When the material is heated to a temperature of 110° to 140° C after exposure, the Ag functions as a catalyst to accelerate the development and the formation of a silver image by reduction of the long-chain fatty acid silver salt by the reducing agent to form a black-and-white image.

The recording material as described above was imagewise exposed and placed for 1 to 2 seconds in a microwave oven (microwave frequency: 2450 MHz; high frequency power: 600 W) to obtain a distinct image. Also, when the exposed recording material was irradiated using a bent wave guide using microwaves of a frequency of 915 MHz and a high frequency power of 25 KW, a distinct image was obtained within 1 second.

In contrast, when a recording material, obtained by coating the same thermally developable light-sensitive layer as described above on a transparent bi-axially stretched polyethylene terephthalate film, was imagewise exposed and placed in the same microwave oven (microwave frequency: 2450 MHz; high frequency power: 600 W) 4 to 5 minutes were required to obtain an image.

Also, when a 100 $\mu$-thick, polyimide film (dielectric constant: 3.3; dielectric loss tangent: 0.008) was superposed on the same recording material as above and placed in a microwave oven (microwave frequency: 2450 MHz; high frequency power: 600 W) 4 to 5 minutes were required to obtain an image similar to the above.

EXAMPLE 2

On a quartz glass having thereon a thin tin oxide film baked at an elevated temperature was coated the same light-sensitive emulsion as described in Example 1 to obtain a recording material. The surface resistance of the conductive layer was $10^2$ ohm/□.

After imagewise exposure, the above-described recording material was placed in a microwave oven (microwave frequency: 2450 MHz; high frequency power: 600 W) for 3 to 5 seconds to obtain a distinct image. When a bent wave guide using microwaves of a frequency of 915 MHz and a high frequency power of 25 KW was used, a distinct image was formed in 1 to 2 seconds.

EXAMPLE 3

On a conductive sheet prepared by dispersing graphite in a polyester was coated the same light-sensitive emulsion as used in Example 1 (surface resistance value: $10^2$ ohm/□). After imagewise exposure, the above-described recording material was placed in a bent wave guide using microwaves of a frequency of 2450 MHz and a high frequency power of 1 KW for 2 to 3 seconds to obtain a distinct image. Also, when carbon black was used in place of graphite, the same results were obtained.

EXAMPLE 4

On an art paper was coated the same light-sensitive emulsion as used in Example 1 to obtain a recording material.

After imagewise exposure of the above-described recording material, a conductive silicone rubber sheet (surface resistance value: $10^2$ ohm/□) prepared by incorporating carbon in a heat-resistant silicone rubber and forming the rubber into a sheet was superposed thereon and placed in a microwave oven (microwave frequency: 2450 MHz; high frequency power: 600 W) for 2 to 3 seconds to obtain a distinct image.

While the invention has been described in detail and with reference to specific embodiments thereof, it will be apparent to one skilled in the art that various changes and modifications can be made therein without departing from the spirit and scope thereof.

What is claimed is:

1. A process for thermal development which comprises irradiating with microwaves an imagewise light exposed thermally developable light-sensitive recording material comprising a support having a conductive material dispersed therein and a thermally developable light-sensitive recording layer on the support and in thermal contact therewith, said support having a surface electric resistence ranging from about 1 ohm/□ to about $10^5$ ohm/□, whereby the heat generated in said support develops said thermally developable recording material.

2. The process of claim 1, wherein said thermally developable light-sensitive recording said layer comprises a silver halide emulsion, a developing agent and a material which releases an alkali upon heating.

3. The process of claim 1, wherein said thermally developable light-sensitive recording, said layer comprises a photolytic diazonium salt and a color coupler.

4. The process of claim 1, wherein said thermally developable light-sensitive recording layer is capable of producing a vesicular image and comprising a photolytic diazonium salt dispersed in a synthetic resin.

5. The process of claim 1, wherein said thermally developable light-sensitive recording said layer comprises a substantially light-insensitive organic silver salt, a light-sensitive silver halide, and a reducing agent.

* * * * *